US011295689B2

(12) United States Patent
Huang

(10) Patent No.: US 11,295,689 B2
(45) Date of Patent: Apr. 5, 2022

(54) DRIVING METHOD, DRIVE CIRCUIT AND DISPLAY DEVICE

(71) Applicant: HKC CORPORATION LIMITED, Shenzhen (CN)

(72) Inventor: Beizhou Huang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/043,717

(22) PCT Filed: Dec. 14, 2018

(86) PCT No.: PCT/CN2018/121208
§ 371 (c)(1),
(2) Date: Sep. 30, 2020

(87) PCT Pub. No.: WO2020/113659
PCT Pub. Date: Jun. 11, 2020

(65) Prior Publication Data

US 2021/0049973 A1 Feb. 18, 2021

(30) Foreign Application Priority Data

Dec. 3, 2018 (CN) ..... 201811466272.5

(51) Int. Cl.
*G09G 3/36* (2006.01)
*G09G 3/3266* (2016.01)
*G09G 5/18* (2006.01)

(52) U.S. Cl.
CPC ..... *G09G 3/3677* (2013.01); *G09G 3/3266* (2013.01); *G09G 3/3674* (2013.01);
(Continued)

(58) Field of Classification Search
CPC .. G09G 3/3677; G09G 3/3688; G09G 3/3674; G09G 3/3266; G09G 2310/08;
(Continued)

(56) References Cited

U.S. PATENT DOCUMENTS 7,075,509 B2 * 7/2006 Minami ..... G09G 5/18 345/98
8,471,804 B2 * 6/2013 Wu ..... G09G 3/36 345/99

(Continued)

FOREIGN PATENT DOCUMENTS

CN 102044223 A 5/2011
CN 104916263 A 9/2015

(Continued)

*Primary Examiner* — Dismery Mercedes
(74) *Attorney, Agent, or Firm* — Bayramoglu Law Offices LLC

(57) ABSTRACT

A driving method, a drive circuit and a display device are provided. The driving method includes: receiving a drive control signal output by a timing control circuit and a drive voltage signal output by a drive circuit; performing an AND calculation of the drive control signal and the drive voltage signal to output a corresponding execution control signal; and outputting an initial scanning signal by the timing control circuit according to the execution control signal.

16 Claims, 3 Drawing Sheets

(52) U.S. Cl.
CPC ..... *G09G 3/3688* (2013.01); *G09G 5/18* (2013.01); *G09G 2310/0267* (2013.01); *G09G 2310/08* (2013.01); *G09G 2320/0247* (2013.01)

(58) Field of Classification Search
CPC ... G09G 2310/0267; G09G 2310/0278; G09G 2320/02; G09G 2320/0247; G09G 2320/0252; G09G 2320/0233; G09G 2320/0209; G09G 2320/0626; G09G 5/18
See application file for complete search history.

(56) References Cited

U.S. PATENT DOCUMENTS 8,847,941 B2 * 9/2014 Tanaka ..... G09G 3/2096 345/211
8,907,939 B2 * 12/2014 Liu ..... G09G 3/2096 345/212
9,224,349 B2 * 12/2015 Park ..... G09G 5/18
10,971,100 B2 * 4/2021 Zhang ..... G09G 3/3685
2007/0001980 A1 * 1/2007 Bae ..... G09G 3/3611 345/98
2011/0273434 A1 11/2011 Park
2012/0162054 A1 * 6/2012 Wang ..... G09G 3/3677 345/92
2012/0176359 A1 * 7/2012 Xiao ..... G09G 3/3688 345/211
2012/0242644 A1 * 9/2012 Liu ..... G09G 3/20 345/212
2015/0154902 A1 * 6/2015 Lee ..... G09G 3/20 345/213
2017/0116926 A1 * 4/2017 Bong ..... G11C 19/186

FOREIGN PATENT DOCUMENTS

CN 105632435 A 6/2016
CN 108182918 A 6/2018
CN 108447452 A 8/2018

* cited by examiner

DRIVING METHOD, DRIVE CIRCUIT AND DISPLAY DEVICE

CROSS REFERENCE TO THE RELATED APPLICATIONS

This application is the national phase entry of International Application No. PCT/CN2018/121208, filed on Dec. 14, 2018, which is based upon and claims priority to Chinese Patent Application No. 201811466272.5, filed on Dec. 3, 2018, the entire contents of which are incorporated herein by reference.

TECHNICAL FIELD

The present application relates to the field of display technology, and more particularly to a driving method, a drive circuit and a display device.

BACKGROUND

The statements provided herein are merely background information related to the present application, and do not necessarily constitute any prior arts. In the thin film transistor liquid crystal display (TFT-LCD), a system mainboard transmits a R/G/B compression signal, a control signal and a power signal, through wires, to connectors on printed circuit board (PCB), and then the video data after being processed by a timing controller (TCON) chip on the printed circuit board, via the printed circuit board, is transmitted to a display area of a panel through the Source-Chip on Film (S-COF) and the Gate-Chip on Film (G-COF), so that the liquid crystal display obtains the required power signal.

However, since the drive circuit needs to be initialized after the thin film transistor liquid crystal display is powered on, which will lead to a voltage difference between two ends of the corresponding liquid crystal when scanning lines are turned on, resulting in abnormal flashing.

SUMMARY

An object of the present application is to provide a driving method, which includes, but not limited to, eliminating the voltage difference between the two ends of the corresponding liquid crystal when the scanning lines are turned on, so as to eliminate the phenomenon of abnormal flashing.

An object of the present application is to provide a driving method, which includes the following steps:

receiving a drive control signal output by a timing control circuit and a drive voltage signal output by a drive circuit;

performing an AND calculation of the drive control signal and the drive voltage signal, and outputting a corresponding execution control signal;

receiving the execution control signal by the timing control circuit and outputting an initial scanning signal according to the execution control signal.

In an embodiment, the step of performing the AND calculation of the drive control signal and the drive voltage signal and outputting the corresponding execution control signal includes:

setting the execution control signal as a low-level signal, when the drive control signal is a low-level signal and the drive voltage signal is a high-level signal;

setting the execution control signal as a low-level signal, when the drive control signal is a high-level signal and the drive voltage signal is a low-level signal;

setting the execution control signal as a high-level signal, when the drive control signal is a high-level signal and the drive voltage signal is a high-level signal.

In an embodiment, the drive circuit is a source driver chip.

In an embodiment, the timing control circuit is a timing controller chip, and the timing controller chip is configured to output the initial scanning signal to the source driver chip.

In an embodiment, the step of receiving the execution control signal, by timing control circuit, and outputting the initial scanning signal according to the execution control signal includes:

outputting the initial scanning signal by the timing control circuit, when the execution control signal is a high-level signal.

In an embodiment, the driving method further includes:

stopping receiving the execution control signal by the timing control circuit after the timing control circuit outputs the initial scanning signal.

In an embodiment, a voltage of the initial scanning signal is a reference voltage for deflection of liquid crystal molecules.

Another object of the present application is to provide a drive circuit, which includes:

a scan drive circuit configured to output a drive voltage signal;

a timing control circuit configured to output a drive control signal; and a logic processing circuit connected with the scan drive circuit and the timing control circuit, respectively, and configured to perform an AND calculation of the drive control signal and the drive voltage signal, and output a corresponding execution control signal;

the timing control circuit is further configured to output an initial scanning signal according to the execution control signal.

In an embodiment, the logic processing circuit includes an AND gate, a first input of the AND gate serves as a first input of the logic processing circuit and is connected with a drive control signal output of the timing control circuit, a second input of the AND gate serves as a second input of the logic processing circuit and is connected with a drive voltage signal output of the scan drive circuit, and an output of the AND gate serves as an output of the logic processing circuit.

In an embodiment, the timing control circuit is a timing controller chip, and the logic processing circuit is integrated in the timing controller chip.

In an embodiment, the scan drive circuit is a driver chip, and the logic processing circuit is integrated in the driver chip.

In an embodiment, the timing control circuit is configured to output the initial scanning signal, when the execution control signal is a high-level signal.

In an embodiment, the timing control circuit is configured to stop receiving the execution control signal after outputting the initial scanning signal.

Another object of the present application is to provide a display device, including:

a display panel; and a control circuit including a drive circuit;

the drive circuit includes:

a scan drive circuit configured to output a drive voltage signal;

a timing control circuit configured to output a drive control signal; and a logic processing circuit connected with the scan drive circuit and the timing control circuit, respectively, and configured to perform an AND calculation of the drive control signal and the drive voltage signal, and output a corresponding execution control signal;

the timing control circuit is further configured to output an initial scanning signal according to the execution control signal.

The embodiment of the present application provides a drive amplifier, drive circuit, and a display device. By receiving the drive control signal output by the timing control circuit and the drive voltage signal output by the drive circuit, and performing the AND calculation of the drive control signal and the drive voltage signal to output the corresponding execution control signal, and then the timing control circuit outputs the initial scanning signal according to the execution control signal, so that the scanning signal can be output effectively, and the drive circuit is initialized after the TFT-LCD is powered on. When the scanning lines is turned on, it eliminates the voltage difference between the two ends of the corresponding liquid crystal, thereby eliminating the phenomenon of abnormal flashing.

BRIEF DESCRIPTION OF THE DRAWINGS

In order to explain the technical solution of embodiments of the present application more clearly, a brief introduction regarding the accompanying drawings that need to be used for describing the embodiments or exemplary technology is given below; Obviously, the drawings in the following description are merely some embodiments of the present application, and for ordinarily skilled one in the art, other drawings can also be obtained according to the current drawings on the premise of paying no creative labor.

DETAILED DESCRIPTION OF THE EMBODIMENTS

Figure 1:
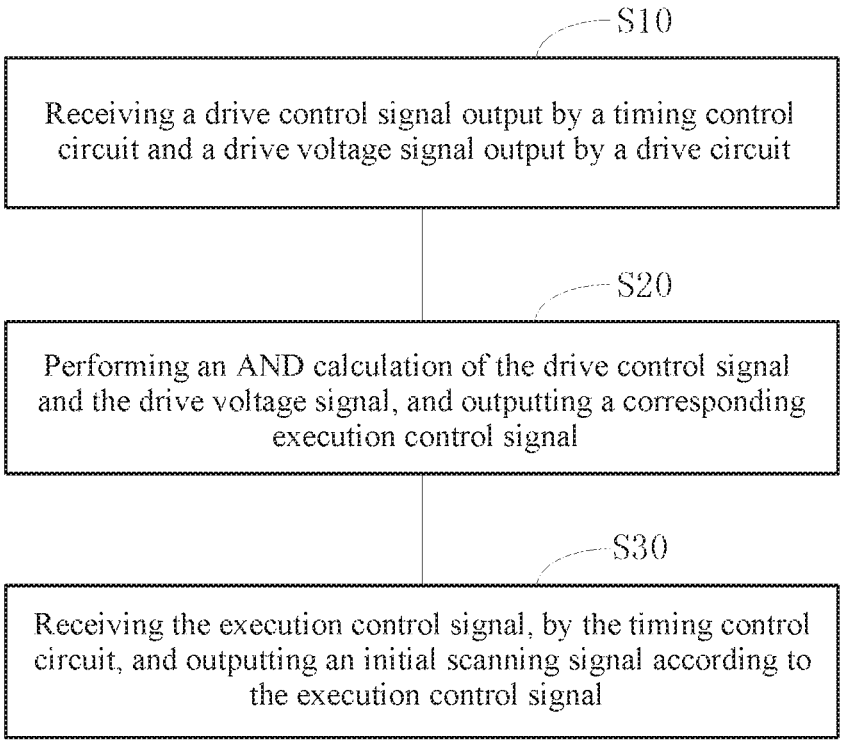
FIG. 1 is a schematic flowchart of a driving method in accordance with an embodiment of the present application.

In order to make the objectives, technical solutions and advantages of the present application more comprehensible, the following further describes the present application in detail with reference to the accompanying drawings and embodiments. It should be understood that the specific embodiments described herein are merely used to explain the present application, and are not intended to limit the present application.

It should be noted that when a component is referred to as being "fixed to" or "arranged/provided on" another component, it can be directly or indirectly on the other component. When a component is referred to as being "connected to/with" another component, it can be directly or indirectly connected with the other component. The terms "upper", "lower", "left", "right", etc. indicate the orientation or positional relationship based on the orientation or positional relationship shown in the drawings, which are merely for ease of description, and are not indicated or implied the device or the element referred to must have a specific orientation, be constructed and operated in a specific orientation, and therefore cannot be understood as limitations of the present application. For those of ordinary skill in the art, specific meaning of the above terms can be understood according to specific conditions. The terms "first" and "second" are merely used for ease of description, and cannot be understood as indicating or implying relative importance or implicitly indicating the number of technical features. The meaning of "a plurality" means two or more than two, unless otherwise specifically defined.

In order to illustrate the technical solutions described in the present application, the following further describes in detail with reference to specific drawings and embodiments.

FIG. 1 is a schematic flowchart of a driving method in accordance with an embodiment of the present application.

As shown in FIG. 1, the driving method in this embodiment includes:

Step S10: receiving a drive control signal output by a timing control circuit and a drive voltage signal output by a drive circuit;

Step S20: performing an AND calculation of the drive control signal and the drive voltage signal, and outputting a corresponding execution control signal;

Step S30: receiving the execution control signal, by the timing control circuit, and outputting an initial scanning signal according to the execution control signal.

In an embodiment, the timing control circuit is a timing controller chip (T-CON IC), and the drive circuit is a source driver chip, where the timing controller chip is configured to output a drive control signal to the source driver chip to output an initial scanning signal.

In an embodiment, the timing controller chip is further configured to output an initial scanning signal to a driver chip (Gate IC).

When the TFT-LCD is powered on, a reference voltage (Vcom) may reach a predetermined reference voltage in a short period of time, while the drive circuit, due to a reset, the drive voltage signal (Sout) output thereby remains at a state of voltage overflow. In this embodiment, by performing the AND calculation of the drive control signal (TP) output by the timing control circuit and the drive voltage signal (Sout) output by the drive circuit, and outputting the corresponding execution control signal (OP), the execution control signal is output to the timing control circuit, and is set to control the timing control circuit to output an initial scanning signal, where the initial scanning signal is set to control the driver chip to output a scanning signal set to turn on a pixel unit in a display panel.

In an embodiment, the step of performing the AND calculation of the drive control signal and the drive voltage signal and outputting the corresponding execution control signal includes:

setting the execution control signal as a low-level signal, when the drive control signal is a low-level signal and the drive voltage signal is a high-level signal;

setting the execution control signal as a low-level signal, when the drive control signal is a high-level signal and the drive voltage signal is a low-level signal; and setting the execution control signal as a high-level signal, when the drive control signal is a high-level signal and the drive voltage signal is a high-level signal.

Figure 2:
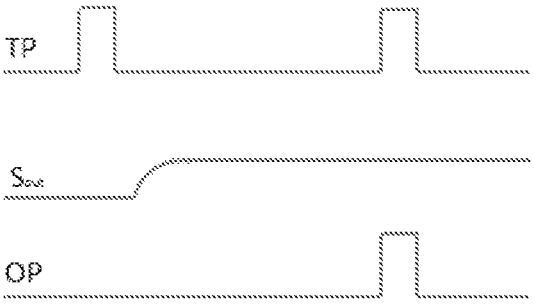
FIG. 2 is a schematic diagram of waveforms of the drive control signal (TP), the drive voltage signal (Sout) and the execution control signal (OP) in accordance with an embodiment of the present application.

FIG. 2 is a schematic diagram of waveforms of a drive control signal (TP), a drive voltage signal (Sout), and an execution control signal (OP) in accordance with an embodiment of the present application.

As shown in FIG. 2, when the drive control signal and the drive voltage signal are both high-level signals, the execution control signal is at a high level, meanwhile, the timing control circuit outputs the initial scanning signal after receiving the execution control signal, and the display panel starts to work.

In an embodiment, the step of receiving the execution control signal by the timing control circuit, and outputting an initial scanning signal according to the execution control signal includes:

outputting the initial scanning signal through the timing control circuit, when the execution control signal is a high-level signal.

In an embodiment, the timing control circuit does not output the initial scanning signal, when the execution control signal is at a low level.

Figure 3:
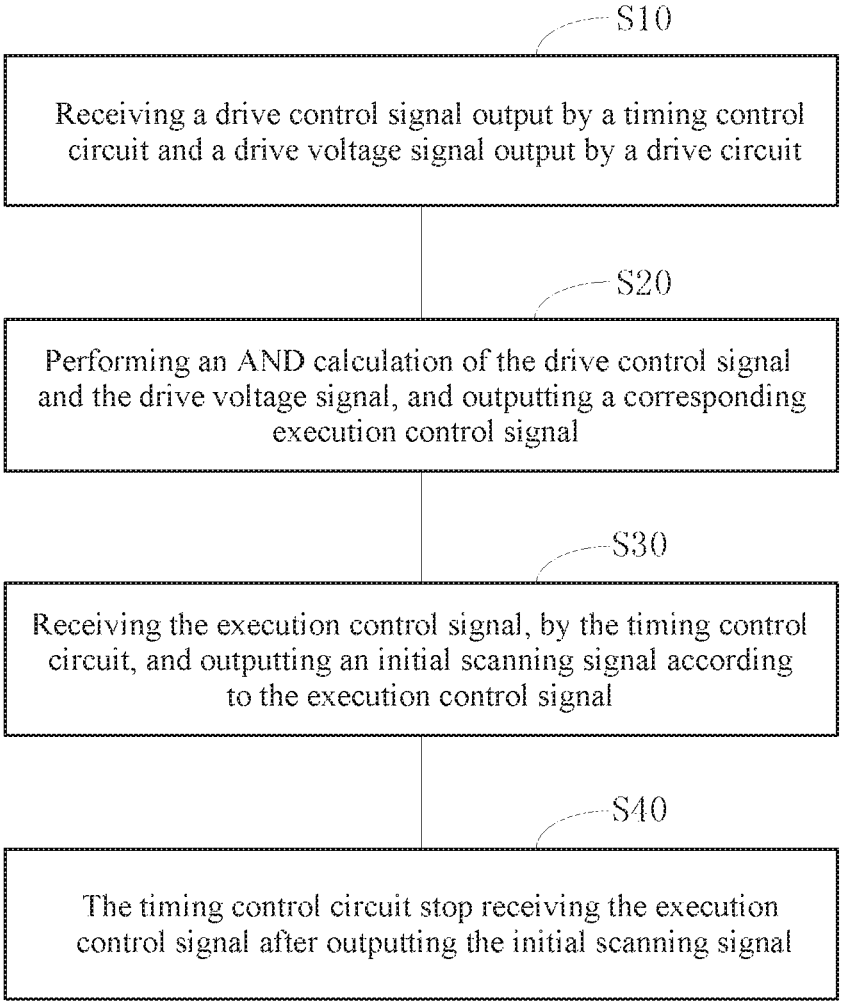
FIG. 3 is a schematic flowchart of a driving method in accordance with another embodiment of the present application.

FIG. 3 is a schematic flowchart of a driving method in accordance with another embodiment of the present application.

Referring to FIG. 3, the driving method in this embodiment further includes:

Step S40: stopping receiving the execution control signal by the timing control circuit after the timing control circuit outputs the initial scanning signal.

In this embodiment, after the timing control circuit outputs the initial scanning signal, a start-up of the display panel is completed. Therefore, the timing control circuit stops receiving the execution control signal and will no longer be affected by the execution control signal, only after the display panel is turned on next time, the timing control circuit outputs the drive control signal again.

In an embodiment, a voltage of the initial scanning signal is a reference voltage for a deflection of liquid crystal molecules.

Figure 4:
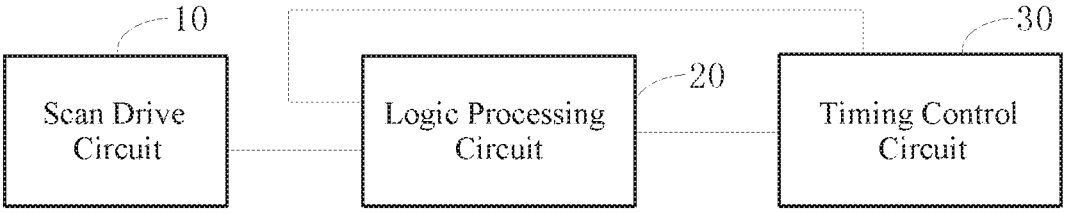
FIG. 4 is a schematic structural diagram of a drive circuit in accordance with an embodiment of the present application.

FIG. 4 is a schematic structural diagram of a drive circuit in accordance with an embodiment of the present application. As shown in FIG. 4, the drive circuit in this embodiment includes:

a scan drive circuit 10 configured to output a drive voltage signal;

a timing control circuit 30 configured to output a drive control signal; and a logic processing circuit 20 connected with the scan drive circuit 10 and the timing control circuit 30, respectively, and configured to perform AND calculation of the drive control signal and the drive voltage signal, and output a corresponding execution control signal;

the timing control circuit 30 is also configured to output an initial scanning signal according to the execution control signal.

In an embodiment, the timing control circuit 30 is a timing controller chip (T-CON IC), and the scan drive circuit 10 is a source driver chip, where the timing controller chip is configured to output a drive control signal to the source driver chip and outputs an initial scanning signal to the driver chip (Gate IC).

When the thin film transistor liquid crystal display is powered on, the reference voltage (Vcom) will reach the predetermined reference voltage in a short time, while the scan drive circuit 10, due to a reset, the drive voltage signal (Sout) output thereby remains at the state of voltage overflow. In this embodiment, by performing the AND calculation of the drive control signal (TP) output by the timing control circuit 30 and the drive voltage signal (Sout) output by the scan drive circuit 10, and outputting the corresponding execution control signal (OP), the execution control signal is output to the timing control circuit, and is set to control the timing control circuit to output an initial scanning signal, where the initial scanning signal is set to control the driver chip to output a scanning signal set to turn on the pixel unit in the display panel.

In an embodiment, the step of performing the AND calculated of the drive control signal (TP) output by the timing control circuit 30 and the drive voltage signal (Sout) output by the scan drive circuit 10 includes:

setting the execution control signal as a low-level signal, when the drive control signal is a low-level signal and the drive voltage signal is a high-level signal;

setting the execution control signal as a low-level signal, when the drive control signal is a high-level signal and the drive voltage signal is a low-level signal; and setting the execution control signal as a high-level signal, when the drive control signal is a high-level signal and the drive voltage signal is a high-level signal.

Referring to FIG. 2, when the drive control signal and the drive voltage signal are both high-level signals, the execution control signal is at a high level, meanwhile, the timing control circuit outputs the initial scanning signal after receiving the execution control signal, and the display panel starts to work.

In an embodiment, the timing control circuit outputs the initial scanning signal, when the execution control signal is a high-level signal.

In an embodiment, the timing control circuit does not output the initial scanning signal, when the execution control signal is at a low level.

In an embodiment, after the timing control circuit 30 outputs the initial scanning signal, the start-up of the display panel is completed. Therefore, the timing control circuit 30 stops receiving the execution control signal and will no longer be affected by the execution control signal, only after the display panel is turned on next time, the timing control circuit 30 outputs the drive control signal again.

In an embodiment, the voltage of the initial scanning signal is the reference voltage for the deflection of liquid crystal molecules.

Figure 5:
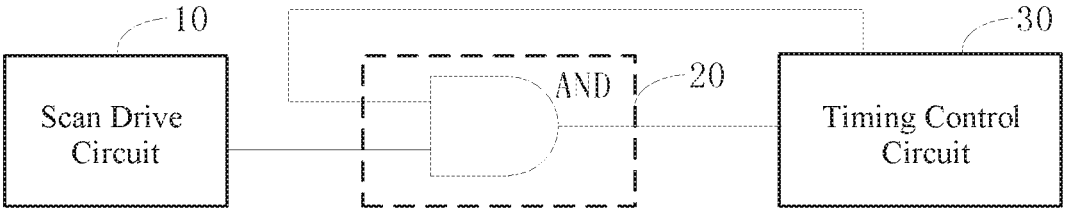
FIG. 5 is a schematic structural diagram of a drive circuit in accordance with another embodiment of the present application.

FIG. 5 is a schematic structural diagram of a drive circuit in accordance with another embodiment of the present application. As shown in FIG. 5, the logic processing circuit 20 includes an AND gate. A first input of the AND gate serves as a first input of the logic processing circuit 20 and is connected with a drive control signal output of the timing control circuit 30. A second input of the AND gate serves as a second input of the logic processing circuit 20 and is connected with a drive voltage signal output of the scan drive circuit 10. An output of the AND gate serves as an output of the logic processing circuit 20.

In an embodiment, the timing control circuit 30 is further configured to stop receiving the execution control signal after outputting the initial scanning signal.

In an embodiment, the timing control circuit 30 is a timing controller chip, and the logic processing circuit 20 is integrated in the timing controller chip.

In an embodiment, the scan drive circuit 10 is a driver chip, and the logic processing circuit 20 is integrated in the driver chip.

Figure 6:
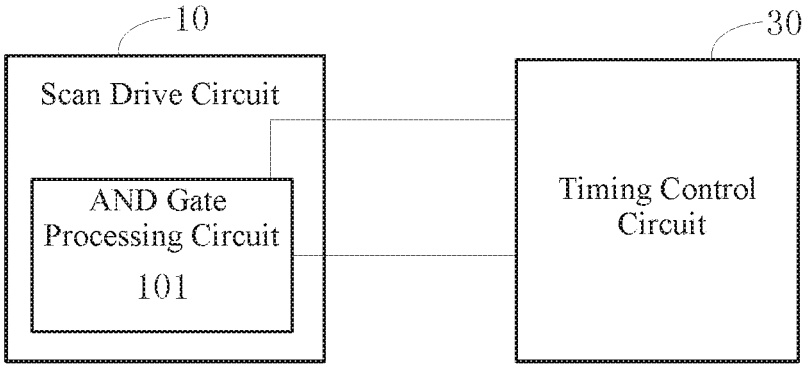
FIG. 6 is a schematic structural diagram of a drive circuit in accordance with another embodiment of the present application.

FIG. 6 is a schematic structural diagram of a drive circuit in accordance with another embodiment of the present application. As shown in FIG. 6, the drive circuit in this embodiment includes:

the scan drive circuit 10 configured to output a drive voltage signal; and the timing control circuit 30 configured to output a drive control signal;

in which, the scan drive circuit 10 also includes an AND gate processing circuit 101 which is configured to perform an AND calculation of the drive control signal and the drive voltage signal, and output a corresponding execution control signal;

the timing control circuit 30 is also configured to output an initial scanning signal according to the execution control signal.

In an embodiment, the AND gate processing circuit 101 includes an AND gate. A first input of the AND gate serves as a first input of the AND gate processing circuit 101 and is connected with an drive control signal output of the timing control circuit 30. A second input of the AND gate serves as a second input of the AND gate processing circuit 101 and is connected with a drive voltage signal output of the scan drive circuit 10. An output of the AND gate serves as an output of the AND gate processing circuit 101.

Figure 7:
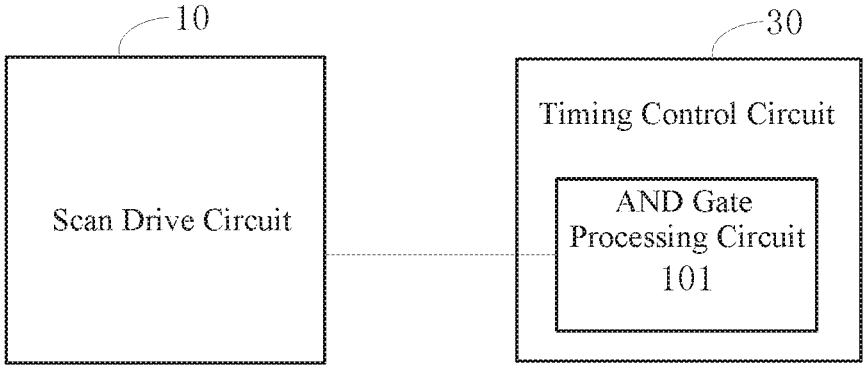
FIG. 7 is a schematic structural diagram of a drive circuit in accordance with another embodiment of the present application.

FIG. 7 is a schematic structural diagram of a drive circuit in accordance with another embodiment of the present application. As shown in FIG. 7, the drive circuit in this embodiment includes:

the scan drive circuit 10 configured to output a drive voltage signal; and the timing control circuit 30 configured to output a drive control signal;

in which, the timing control circuit 30 also includes the AND gate processing circuit 101 which is configured to perform an AND calculation of the drive control signal and the drive voltage signal, and output a corresponding execution control signal;

the timing control circuit 30 is also configured to output an initial scanning signal according to the execution control signal.

In an embodiment, the AND gate processing circuit 101 includes an AND gate. A first input of the AND gate serves as a first input of the AND gate processing circuit 101 and is connected with a drive control signal output of the timing control circuit 30. A second input of the AND gate serves as a second input of the AND gate processing circuit 101 and is connected with a drive voltage signal output of the scan drive circuit 10, and an output of the AND gate serves as an output of the AND gate processing circuit 101.

Figure 8:
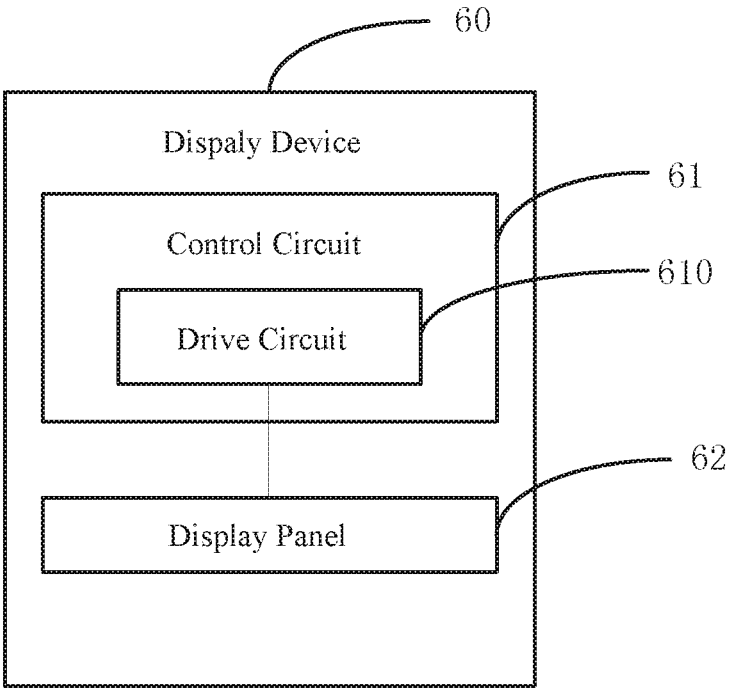
FIG. 8 is a structural block diagram of a display device in accordance with an embodiment of the present application.

FIG. 8 is a schematic structural diagram of a display device in accordance with an embodiment of the present application. As shown in FIG. 8, the display device 60 in this embodiment includes:

a display panel 60; and a control circuit 61 including a drive circuit 610;

in which, the drive circuit 610 includes:

the scan drive circuit 10 configured to output a drive voltage signal;

the timing control circuit 30 configured to output a drive control signal; and the logic processing circuit 20 connected with the scan drive circuit 10 and the timing control circuit 30, respectively, and is configured to perform an AND calculation of the drive control signal and the drive voltage signal, and output a corresponding execution control signal;

the timing control circuit 30 is also configured to output an initial scanning signal according to the execution control signal.

In an embodiment, the timing control circuit 30 is a timing controller chip (T-CON IC), and the scan drive circuit 10 is a source driver chip, where the timing controller chip is configured to output the drive control signal to the source driver chip and output the initial scanning signal to the drive chip (Gate IC).

When the thin film transistor liquid crystal display is powered on, the reference voltage (Vcom) will reach the predetermined reference voltage in a short time, while the scan drive circuit 10 due to a reset, the drive voltage signal (Sout) output thereby remains at the state of voltage overflow. In this embodiment, by performing the AND calculation of the drive control signal (TP) output by the timing control circuit 30 and the drive voltage signal (Sout) output by the scan drive circuit 10, and outputting the corresponding execution control signal (OP), the execution control signal is output to the timing control circuit, and is set to control the timing control circuit to output an initial scanning signal, and the initial scanning signal is set to control the driver chip to output a scanning signal set to turn on the pixel unit in the display panel.

In an embodiment, the step of performing an AND calculation of the drive control signal (TP) output by the timing control circuit 30 and the drive voltage signal (Sout) output by the scan drive circuit 10 includes:

setting the execution control signal as a low-level signal, when the drive control signal is a low-level signal and the drive voltage signal is a high-level signal;

setting the execution control signal as a low-level signal, when the drive control signal is a high-level signal and the drive voltage signal is a low-level signal; and setting the execution control signal as a high-level signal, when the drive control signal is a high-level signal and the drive voltage signal is a high-level signal.

Referring to FIG. 2, when the drive control signal and the drive voltage signal are both high-level signals, the execution control signal is at a high level, meanwhile, the timing control circuit outputs the initial scanning signal after receiving the execution control signal, and the display panel starts to work.

In an embodiment, the initial scanning signal is output through the timing control circuit, when the execution control signal is a high-level signal.

In an embodiment, the timing control circuit does not output the initial scanning signal, when the execution control signal is at a low level.

In an embodiment, after the timing control circuit 30 outputs the initial scanning signal, the start-up of the display panel is completed. Therefore, the timing control circuit 30 stops receiving the execution control signal and will no longer be affected by the execution control signal, only after the display panel is turned on next time, the timing control circuit 30 outputs the drive control signal again.

In an embodiment, the voltage of the initial scanning signal is a reference voltage for the deflection of liquid crystal molecules.

FIG. 5 is a schematic structural diagram of a drive circuit in accordance with another embodiment of the present application. As shown in FIG. 5, the logic processing circuit 20 includes the AND gate. The first input of the AND gate serves as the first input of the logic processing circuit 20 and is connected with the drive control signal output of the timing control circuit 30. The second input of the AND gate serves as the second input of the logic processing circuit 20 and is connected with the drive voltage signal output of the scan drive circuit 10. The output of the AND gate serves as the output of the logic processing circuit 20.

In an embodiment, the timing control circuit 30 is also configured to stop receiving the execution control signal after outputting the initial scanning signal.

In an embodiment, the timing control circuit 30 is a timing controller chip, and the logic processing circuit 20 is integrated in the timing controller chip.

In an embodiment, the scan drive circuit 10 is a driver chip, and the logic processing circuit 20 is integrated in the driver chip.

In an embodiment, as shown in FIG. 6, the drive circuit 610 includes:

the scan drive circuit 10 configured to output a drive voltage signal; and the timing control circuit 30 configured to output a drive control signal;

in which, the scan drive circuit 10 also includes an AND gate processing circuit 101, which is configured to perform an AND calculation of the drive control signal and the drive voltage signal, and output a corresponding execution control signal;

The timing control circuit 30 is also configured to output an initial scanning signal according to the execution control signal.

In an embodiment, the AND gate processing circuit 101 includes an AND gate. The first input of the AND gate serves as the first input of the AND gate processing circuit 101 and is connected with the drive control signal output of the timing control circuit 30. The second input of the AND gate serves as the second input of the AND gate processing circuit 101 and is connected with the drive voltage signal output of the scan drive circuit 10. The output of the AND gate serves as the output of the AND gate processing circuit 101.

As shown in FIG. 7, in an embodiment, the drive circuit 610 may also include:

the scan drive circuit 10 configured to output a drive voltage signal; and the timing control circuit 30 configured to output a drive control signal;

in which, the timing control circuit 30 further includes an AND gate processing circuit 101, which is configured to perform the AND calculation of the drive control signal and the drive voltage signal, and output a corresponding execution control signal;

the timing control circuit 30 is also configured to output an initial scanning signal according to the execution control signal.

In an embodiment, the AND gate processing circuit 101 includes an AND gate The first input of the AND gate serves as the first input of the AND gate processing circuit 101 and is connected with the drive control signal output of the timing control circuit 30. The second input of the AND gate serves as the second input of the AND gate processing circuit 101 and is connected with the drive voltage signal output of the scan drive circuit 10. The output of the AND gate serves as the output of the AND gate processing circuit 101.

In an embodiment, the display device 60 may be any type of display device provided with the above-mentioned drive circuit 610, such as a Liquid Crystal Display (LCD), an Organic Electroluminesence Display (OLED), Quantum Dot Light Emitting Diodes (QLED) or curved display device, etc.

In an embodiment, the display panel 62 includes a pixel array composed of multiple rows of pixels and multiple columns of pixels.

In an embodiment, the control circuit 61 may be implemented by a general integrated circuit, such as a central processing unit (CPU), or an application specific integrated circuit (ASIC).

The embodiment of the present application provides a drive amplifier, a drive circuit and a display device. By receiving the drive control signal output by the timing control circuit and the drive voltage signal output by the drive circuit, and performing the AND calculation of the drive control signal and the drive voltage signal to output the corresponding execution control signal, and then the timing control circuit outputs the initial scanning signal according to the execution control signal, so that the scanning signal can be output effectively, and the drive circuit is initialized after the TFT-LCD is powered on. When the scanning lines is turned on, it eliminates the voltage difference between the two ends of the corresponding liquid crystal, thereby eliminating the phenomenon of abnormal flashing.

It can be understood for persons skilled in the art that all or part of the processes in the above-mentioned method embodiments can be implemented by instructing relevant hardware through a computer program. The program can be stored in a computer readable storage medium, and during an execution, it may include the procedures of the above-mentioned method embodiments. In which the storage medium may be a magnetic disk, an optical disc, a read-only memory (ROM) or a random access memory (RAM), etc.

The above disclosures are merely optional embodiments of the present application, and are not intended to limit the present application. Any modifications, equivalent replacements and improvements made within the spirit and principle of the present application shall be included by the protection scope of the present application.

What is claimed is:

1. A driving method, comprising:

receiving a drive control signal output by a timing control circuit and a drive voltage signal output by a drive circuit;

performing an AND calculation of the drive control signal and the drive voltage signal, and outputting an execution control signal corresponding to the AND calculation;

receiving the execution control signal by the timing control circuit and outputting an initial scanning signal according to the execution control signal; and stopping receiving the execution control signal by the timing control circuit after the timing control circuit outputs the initial scanning signal.

2. The driving method of claim 1, wherein the step of performing the AND calculation of the drive control signal and the drive voltage signal and outputting the execution control signal corresponding to the AND calculation comprises:

setting the execution control signal as a low-level signal, when the drive control signal is the low-level signal and the drive voltage signal is a high-level signal;

setting the execution control signal as the low-level signal, when the drive control signal is the high-level signal and the drive voltage signal is the low-level signal; and setting the execution control signal as the high-level signal, when the drive control signal is the high-level signal and the drive voltage signal is the high-level signal.

3. The driving method of claim 1, wherein the drive circuit is a source driver chip.

4. The driving method of claim 3, wherein the timing control circuit is a timing controller chip, and the timing controller chip is configured to output the initial scanning signal to the source driver chip.

5. The driving method of claim 1, wherein the step of receiving the execution control signal, by the timing control circuit, and outputting the initial scanning signal according to the execution control signal comprises:

outputting the initial scanning signal by the timing control circuit, when the execution control signal is a high-level signal.

6. The driving method of claim 1, wherein a voltage of the initial scanning signal is a reference voltage for deflection of liquid crystal molecules.

7. A drive circuit, comprising:

a scan drive circuit, wherein the scan drive circuit is configured to output a drive voltage signal;

a timing control circuit, wherein the timing control circuit is configured to output a drive control signal; and a logic processing circuit, wherein the logic processing circuit is connected to the scan drive circuit and the timing control circuit, respectively, and the logic processing circuit is configured to perform an AND calculation of the drive control signal and the drive voltage signal, and output an execution control signal corresponding to the AND calculation;

wherein the timing control circuit is further configured to receive the execution control signal and output an initial scanning signal according to the execution control signal, and the timing control circuit is further configured to stop receiving the execution control signal after the initial scanning signal is output.

8. The drive circuit of claim 7, wherein the logic processing circuit comprises an AND gate, wherein a first input of the AND gate serves as a first input of the logic processing circuit, and the first input of the AND gate is connected to a drive control signal output of the timing control circuit;

a second input of the AND gate serves as a second input of the logic processing circuit, and the second input of the AND gate is connected to a drive voltage signal output of the scan drive circuit; and an output of the AND gate serves as an output of the logic processing circuit.

9. The drive circuit of claim 7, wherein the timing control circuit is a timing controller chip, and the logic processing circuit is integrated in the timing controller chip.

10. The drive circuit of claim 7, wherein the scan drive circuit is a driver chip, and the logic processing circuit is integrated in the driver chip.

11. The drive circuit of claim 7, wherein the timing control circuit is configured to output the initial scanning signal, when the execution control signal is a high-level signal.

12. A display device, comprising:

a display panel; and a control circuit comprising a drive circuit;

wherein the drive circuit comprises:

a scan drive circuit, wherein the scan drive circuit is configured to output a drive voltage signal;

a timing control circuit, wherein the timing control circuit is configured to output a drive control signal; and a logic processing circuit, wherein the logic processing circuit is connected to the scan drive circuit and the timing control circuit, respectively, and the logic processing circuit is configured to perform an AND calculation of the drive control signal and the drive voltage signal, and output an execution control signal corresponding to the AND calculation;

wherein the timing control circuit is further configured to receive the execution control signal and output an initial scanning signal according to the execution control signal, and the timing control circuit is further configured to stop receiving the execution control signal after the initial scanning signal is output.

13. The display device of claim 12, wherein the logic processing circuit comprises an AND gate, wherein a first input of the AND gate serves as a first input of the logic processing circuit, and the first input of the AND gate is connected to a drive control signal output of the timing control circuit;

a second input of the AND gate serves as a second input of the logic processing circuit, and the second input of the AND gate is connected to a drive voltage signal output of the scan drive circuit; and an output of the AND gate serves as an output of the logic processing circuit.

14. The display device of claim 12, wherein the timing control circuit is a timing controller chip, and the logic processing circuit is integrated in the timing controller chip.

15. The display device of claim 12, wherein the scan drive circuit is a driver chip, and the logic processing circuit is integrated in the driver chip.

16. The display device of claim 12, wherein the timing control circuit is configured to output the initial scanning signal, when the execution control signal is a high-level signal.

* * * * *